US009532695B2

(12) United States Patent
Sacks

(10) Patent No.: US 9,532,695 B2
(45) Date of Patent: Jan. 3, 2017

(54) DRY, WASHABLE AND REUSABLE SURFACE CLEANING SUBSTRATE LOADED WITH CLEANING COMPOSITION

(75) Inventor: Roland Sacks, Ruti-Zurich (CH)

(73) Assignee: AVET AG, Ruti-Zurich (CH)

( * ) Notice: Subject to any disclaimer, the term of this patent is extended or adjusted under 35 U.S.C. 154(b) by 568 days.

(21) Appl. No.: 14/005,935

(22) PCT Filed: Mar. 22, 2012

(86) PCT No.: PCT/EP2012/055121
§ 371 (c)(1),
(2), (4) Date: Sep. 18, 2013

(87) PCT Pub. No.: WO2012/127000
PCT Pub. Date: Sep. 27, 2012

(65) Prior Publication Data

US 2014/0000653 A1 Jan. 2, 2014

(30) Foreign Application Priority Data

Mar. 22, 2011 (GB) ..... 1104798.2

(51) Int. Cl.
*A47L 13/17* (2006.01)
*C11D 17/04* (2006.01)

(52) U.S. Cl.
CPC ..... *A47L 13/17* (2013.01); *C11D 17/049* (2013.01)

(58) Field of Classification Search
CPC ..... C11D 17/049; A47L 13/20
See application file for complete search history.

(56) References Cited

U.S. PATENT DOCUMENTS 4,014,808 A 3/1977 Herpers, Jr. et al.
4,624,890 A 11/1986 Lloyd et al.
4,919,835 A * 4/1990 Sigl ..... C11D 3/2086 427/242
4,935,158 A 6/1990 Aszman et al.
6,171,346 B1 * 1/2001 Yeazell ..... A47L 25/08 510/297
7,833,918 B2 * 11/2010 Gormley ..... C11D 1/662 442/170
2002/0175092 A1 * 11/2002 Stulens ..... A47L 13/20 206/229
2003/0127108 A1 * 7/2003 Policicchio ..... A47L 13/20 134/6
2003/0186830 A1 * 10/2003 Godfroid ..... A47L 13/22 510/382
2003/0207630 A1 * 11/2003 Graham ..... C11D 3/0073 442/118
2004/0127378 A1 * 7/2004 Sherry ..... A47L 13/20 510/296
2004/0147425 A1 7/2004 Castro et al.
2004/0226123 A1 * 11/2004 Policicchio ..... A47L 13/20 15/115
2005/0079987 A1 * 4/2005 Cartwright ..... A61K 8/0208 510/296
2005/0096239 A1 * 5/2005 Barnabas ..... C11D 3/3765 510/214
2005/0153857 A1 * 7/2005 Sherry ..... A47L 13/20 510/295
2005/0159063 A1 * 7/2005 Hill ..... A47L 13/16 442/327
2007/0099812 A1 5/2007 Luizzi et al.

FOREIGN PATENT DOCUMENTS

| | | |
|---|---|---|
| DE | 2519745 | 11/1976 |
| EP | 0066463 | 12/1982 |
| EP | 0068830 | 1/1983 |
| EP | 0153146 | 8/1985 |
| EP | 1180343 | 2/2002 |
| EP | 1779834 | 5/2007 |
| FR | 1454617 | 2/1966 |
| GB | 1304375 | 1/1973 |
| GB | 1326080 | 8/1973 |
| GB | 1522759 | 8/1978 |
| JP | 02047397 | 2/1990 |
| WO | 2004046302 | 6/2004 |
| WO | 2005108543 | 11/2005 |

OTHER PUBLICATIONS

International Search Report for PCT/EP2012/055121, Completed by the European Patent Office on Jun. 25, 2012, 4 Pages.
Fitzner et al. SOFW-Journal 2005, vol. 130, p. 54-66, English Version attached to Original, Original SOFW-Journal 2004, vol. 130, p. 83-93, All together 22 Pages. "Recommendation for the Quality Assessment of the Product Performance of All-Purpose Cleaners."

* cited by examiner

*Primary Examiner* — Gregory Webb
(74) *Attorney, Agent, or Firm* — Brooks Kushman P.C.

(57) ABSTRACT

A surface cleaning substrate, which is essentially dry and loaded with a cleaning composition, which may very suitably be stored and transported in its dry form and which may be activated for surface cleaning by simple addition of a carrier, such as water. A method for the manufacture of such a loaded dry substrate, and to the method of surface cleaning using such a loaded dry substrate is also disclosed.

14 Claims, No Drawings

DRY, WASHABLE AND REUSABLE SURFACE CLEANING SUBSTRATE LOADED WITH CLEANING COMPOSITION

CROSS-REFERENCE TO RELATED APPLICATION

This application is the U.S. national phase of PCT Application No. PCT/EP2012/055121 filed on Mar. 22, 2012, which claims priority to Great Britain Patent Application No. 1104798.2 filed on Mar. 22, 2011, the disclosures of which are incorporated in their entirety by reference herein.

FIELD OF THE INVENTION

The present invention relates to a substrate useful for cleaning of surfaces, for example floors. In particular, it relates to a washable and re-usable essentially dry substrate comprising a cleaning composition, which can be wetted just prior to its use. The invention also relates to particular executions for the substrate as well as for the cleaning composition and to a kit of a substrate loaded with a cleaning composition. The invention further relates to a method for loading a washable and reusable substrate with a cleaning composition, and to a recycling look of washing a reusable, washable substrate, loading it with a cleaning substance, drying the loaded substrate, storing/transporting the loaded dry substrate to the cleaning location, where it is wetted, such as by water. Upon cleaning of the surface, the dirt loaded substrate can be recycled to the washing step.

BACKGROUND

For surface cleaning it has long been a desire to combine cleaning compositions, such as detergents or scouring fluids, with a substrate, such that a user does not need to add such a composition for easing the work and/or optimizing the amount of used compositions. The prior art as well as commercial products show two main approaches.

A first approach employs one-time usage substrates, which may be of particular composition, such as microfibres, or may be particularly treated, such as antistatically. They may also comprise additives, such as cleaning compositions, and are delivered to the user in a dry or in a wet state. It is also known to deliver essentially dry ("dry to the touch") substrates, which can be wetted, such as with water, for the cleaning. Upon cleaning, the substrate is loaded with dirt, and discarded once the additive is exhausted and/or the dirt level reaches a critical level.

Such systems not only have the disadvantage that they are inefficient in the use of substrate, which is undesirable both from an economical as well as an ecological point of view. Also, such systems require special precautions with regard to storing and distributing the substrates, particularly if these are wet and thusly are prone to microbial contamination.

JP-A-2 047 397 relates to paper containing soap in its fiber tissues. U.S. Pat. No. 4,935,158 describes a (non-washable) cleaning pad comprising a solid detergent cleaning composition, which is reusable by means of a slow release of the active agent constituents.

The other conventional approach employs re-usable substrates, which are washed and dried and delivered to the cleaning location. There, they may be used as such, as well known for microfiber substrates. Alternatively, a cleaning liquor is prepared, often by adding a cleaning composition to water such as in a bucket with a squeezing insert. A further alternative uses cleaning implements which comprise a dosing unit, such as may be fixed to the handle of the cleaning implement, and which is used to deliver the cleaning liquor to the cleaning surface or substrate.

Such systems typically require that the cleaning liquor is prepared at the cleaning location, which often results in misdosage of the cleaning composition and/or of the water, which may result in unsatisfactory cleaning results, such as poor dirty pick-up and/or streaking, and which, in the case of overdosing, may deteriorate economics. In particular for professional cleaning, the use of larger containers for the cleaning composition may lead to complications in the logistics chain or on site. Further a significant portion of the cleaning composition is discarded with the cleaning liquor after use.

EP-A-0 153 146 relates to an article suitable for wiping surfaces including a substrate which can carry the detergent that is delivered to the surface during wiping. U.S. Pat. No. 4,014,808 describes a detergent formulation useful in aqueous working solution for the treatment of soiled floor surfaces. Other wiping articles and the like have been described, for example, in GB No. 1 522 759 (Airwick); EP 66 463A (Unilever); EP No. 68 830A (Unilever); GB No. 1 326 080 (Freudenberg); and GB No. 1 304 375 (L'Oreal). Therein, the active material (liquid or solid but usually liquid) is generally encapsulated or compartmented in some way and can be released only by the application of some stimulus, for example, squeezing, rubbing or wetting.

However, none of the publications addresses the problem of providing washable and re-usable substrates, which are essentially dry and which are preloaded with a cleaning composition for being wetted upon use. Also, there is no disclosure of loading a washable substrate with a cleaning composition during or after washing and subsequently storing and/or transporting it in a dry state to the cleaning location.

Thus, in one aspect the present invention addresses the remaining problems by providing a re-usable and washable substrate, which has been loaded with suitable cleaning substances but which can be stored and transported in an essentially dry state. In another aspect, the present invention relates to the method of preparing such a loaded, essentially dry substrate, and in a further aspect to a method for cleaning a surface, whereby a substrate is used, which is washed after being used and dirt loaded and loaded with a cleaning composition thereafter, such that it can be stored and/or relocated to the cleaning location, where it is combined with a cleaning carrier, such as water.

DETAILED DESCRIPTION

The present invention is directed towards cleaning of surfaces, often flat and/or hard surfaces, such as floors or windows and the like though it may be used for other purposes. A typical application relates to the cleaning of floors by using mop-like structures. To this end, the present invention is directed towards a cleaning composition which, in combination with a cleaning substrate and a cleaning carrier (such as water), can be used for wet cleaning of surfaces, such as a floor. It is an important element of the present invention, that the cleaning substrate is re-useable. After the cleaning, the dirt loaded substrate can be washed by means of a washing composition and a liquid washing carrier and re-loaded with the cleaning composition. Preferably, though not necessarily, the washing and the loading step are performed in the same location and even more preferably in the same process, such as in the same machine. After the washing and loading step, the loaded substrate is dried and can be stored and/or be transported to the cleaning location in the dry state, where it is wetted by the user with a liquid cleaning carrier for wet cleaning.

A substrate is a porous material, typically a fibrous web or pad, exhibiting a thickness or z-dimension/direction and a length (x-) and width (y-) dimension/direction. Though less preferred, the substrate may be in the form of a sponge or of a bundle of yarns of typically more than 5 cm and less than 50 cm, fixed together at one end to a handle and loose at the other. In a preferred execution the substrate may be produced in the form of an essentially endless web and cut into shape to form a substrate pad. The substrate web may be produced by various well known methods, such as by being formed as a non-woven material, knitted or by yarns attached—such as by stitching—to abuse material. Optionally, and often preferably, the yarn may be looped and/or twisted. Such a cleaning pad as may be used for floor cleaning may have a width of from 0.25 m to 1.6 m or even more, and a length of from 0.02 m or 0.05 m to about 0.4 or 0.5 m, its thickness may range from 3 mm or 5 mm to over 30 mm, or even 50 mm. The pad may be rectangularly shaped in its x-y-dimension, often it is trapezoidally shaped. The substrate web or pad may comprise one or more zones, such as parallel stripes made of polyester and a polyester-polyamide composite respectively. The substrate may be used as such or it may be adapted to be connected to a pad- or substrate-holder by any conventional means.

The term cleaning composition relates to materials useful for the surface cleaning process, such as for the cleaning of floors. Such cleaning compositions may be applied to the surfaces by means of the substrate supported by a liquid cleaning carrier, such that a substrate comprising cleaning liquor, comprising the cleaning composition and the cleaning carrier, removes the dirt from the surface whilst leaving some cleaning liquor on the surface. In the most preferred execution of the present invention, such a cleaning carrier is water. Optionally, the cleaning composition may comprise additives, such as perfumes.

The term "compound" generally refers to chemically essentially identically behaving materials, such as can be described by a chemical name. The term "composition" generally refers to at least one but typically more than one compound. The term "carrier" refers to typically liquid matters containing compounds or compositions, which are dissolved or suspended therein.

The term "liquid" refers to substances, which are liquid at normal use and storage conditions, i.e. ambient conditions of between 0° C. and 30°, typically at 22° C., in particular, if the composition comprises meltable compounds, such as waxes. A liquid may comprise a carrier, such as water or solvents, dissolved substances, or dispersed substances, such as colloids or dispersions.

The term washing composition relates to substances as may suitably be used for the washing of the dirt loaded substrates in a liquid washing carrier, such as water or solvents, such as liquefied $CO_2$, in the case of dry-cleaning. The washing liquor comprises the washing composition and the washing carrier.

The term "impregnating" applies to the loading of the substrate with the cleaning composition. Preferably the substrate is treated with an impregnating aid. As is dicussed in more detail herein below, the impregnating aid may be added in different forms at different stages of the process. Without wishing to be bound by the theory, it is believed, that the impregnating aid modifies the surface properties of the substrate and thusly enhances the deposition and/or retention of the cleaning composition in or on the surface of the substrate.

The term impregnating composition is used for substances, which are applied to the washed substrate, and which comprise the cleaning composition, typically though not necessarily in a fluid impregnating carrier, optionally impregnating aids, and optionally other additives. At least the cleaning composition of the impregnating composition is intended to be deposited in or on the surface of the substrate so as to be available for the cleaning step. Often, the impregnating carrier is applied as a liquid, such as water or solvents. The impregnating liquor comprises the impregnating composition, which comprises the cleaning composition, and may further comprise a liquid impregnating carrier, optionally an impregnating aid, and optionally other additives. The impregnating of the substrate is executed in a separate process step after the washing process, such as when the substrate, for economic reasons preferably not fully dried, is impregnated with the impregnating liquor comprising the impregnating composition and optionally impregnating carrier. Particularly if the impregnating composition is in a liquid state, it may be applied as such without the use of an impregnating carrier. Thus the substrate is loaded in an impregnating step with cleaning composition by depositing the cleaning composition on the substrate such as by adding cleaning composition to the substrate in a post-washing step, such as—in analogy to adding a fabric conditioner—by impregnating the substrate with a cleaning liquor. Within the context of the present invention, at least some of the cleaning composition is adhered to or immobilized in or on the surface of the substrate. This refers to the condition that the cleaning composition is retained in the substrate under normal handling, such as may be assessed by a shake out test. This immobilization of the cleaning composition should however be non-permanent so as to allow the release of the cleaning composition upon contact with the cleaning carrier. Henceforth, it is desirable to not irreversibly adhere the cleaning composition to the substrate such as by covalent bonding.

The term "drying" refers in the general meaning to the removal of excess liquid carrier from the substrate, which may be achieved mechanically (like draining, wringing, squeezing, spinning, pressing, mangling, calendering) or in the more specific meaning of the term thermally, or by a combination thereof. The term "thermal drying" includes drying under ambient conditions, such as by evaporation of the liquid into the ambient air. During the drying step, other processes may occur simultaneously, such as an improvement of the immobilization of the cleaning composition in or on the surface of the substrate by the increased temperatures, though care should be taken to not irreversibly bond too much of the cleaning composition to the substrate.

Without wishing to be bound by the theory, it is believed, that particular compounds as may be selected for the cleaning composition and combining these with an impregnating aid as well as employing particular components used for the washing composition enable relatively high amounts of cleaning composition on a substrate.

Loaded Dry Substrate

In a first aspect, the present invention relates to an essentially dry washable and re-usable substrate loaded with cleaning composition.

Substrates useful in the present invention can be selected from a broad range of materials. Whilst conventional substrates can conveniently be employed, preferred executions are selected for or adapted to provide good adhesion of the cleaning composition to the substrate or to portions or regions of the substrate. Thus, a preferred substrate comprises materials which are selected for or adapted to the specific properties of the compositions—in particular the cleaning composition—and carriers—in particular the impregnating carrier and the cleaning carrier. The substrate may also be selected as to its ability to absorb or retain cleaning or impregnating carrier. The substrate may be made out of fibres or other materials, which do not absorb liquids upon being in contact therewith, such as is typically the case with synthetic polymeric material, such as polyester, polyamide, or polypropylene etc. The substrate may also comprise fibres which swell upon contact with liquids, such as cotton fibres or yarns, or cellulosed based materials such a treated or untreated cellulose fibres or rayon/viscose fibres and the like. In a preferred execution, the structure comprises materials like polyester, polyamide, or cellulosic based materials like cotton, or Rayon/Viscose. Less preferred materials, such as, polypropylene, polyethylene, or wool may be treated, such as by surface treatment, or by being used in combination with other materials such as resin incorporated additives to improve properties.

A substrate can be a homogeneous material, i.e. consisting essentially of the same composition and exhibiting essentially constant properties throughout its thickness (z-direction) and length (x-direction) and width (z-) direction, whereby the latter two are typically larger than the thickness and will typically be employed so as to be in contact with the cleaning surface. Typically, however, the substrate will be a composite material. Such a composite material may be a layered structure i.e. comprising a z-directional arrangement of different zones exhibiting different properties, such as may be achieved by layering different materials. It may also be a regioned structure, i.e. by comprising x- and/or y directional arrangement of different regions exhibiting different properties. Further, it can be a combination of both, e.g. a regioned structure being enveloped by a layer of a different material. The transition between the regions can be gradual, such as may be the case, if one and the same material has been treated by chemical or physical processes in different regions, or it can be a discontinuity, such as by positioning different materials next to each other. If various zones or regions are compared by their properties, such as composition, surface properties, or loading, the volume for such comparisons should not be less than about 125 $mm^3$ or not less than about 5 mm in each dimension or the area, where applicable. If the variation is across a volume or area smaller than this, the characteristics are to be averaged across such a volume.

The substrate exhibits a macroscopic surface such as may be optimized to be in contact with the cleaned surface, and thus may be essentially flat. However, a substrate may often exhibit a varying thickness, e.g. when stripes of different materials are employed. In particular when the substrate comprises looped yarns, the substrate has an internal surface as created by the surface of the yarns and fibres, which may be significantly higher than the macroscopic one.

When a cleaning composition is immobilized in or on the surface of the substrate, this refers to the fact, that essentially solid cleaning composition is distributed within or on the substrate, i.e. immobilized on any of the described surfaces and/or may be trapped between or within the substrate structures such as fibres or yarns.

An important requirement, which the substrate has to satisfy, is its washability, i.e. it does essentially not disintegrate upon wetting with liquids, such as the carriers described above, such as water, preferably in conventional washing or cleaning machines of the "household" or of the "industrial" type. Further, it has to be re-useable, i.e. can be used and washed multiple times or even essentially endlessly.

A substrate according to the present invention is loaded with the cleaning composition by comprising at least 1 weight-%, preferably more than 5 weight-%, more preferably more than 20 weight-% and most preferably more than 40 weight-%, based on the dry weight of the substrate, as may be determined as described herein below. If the substrate is a composite zoned or regioned material, at least one of the zones or regions should satisfy the loading requirement.

The cleaning composition is preferably released readily but not too quickly from the substrate upon being in contact with the cleaning carrier, as can be assessed by the surfactant release method as described herein below. Preferably there are more than 30 weight % but less than 50 weight % released in the first cycle, and more than 90 weight % in the fifth cycle.

A loaded dry substrate according to the present invention is essentially dry. Within the present context, "essentially dry" means, that it has to be "dry to the touch" but also, that it can be stored over an extended period between the washing and preparation and the use without requiring particular attention with regard to storage and/or packaging in view of the liquid level contained therein. Thus, a substrate according to the present invention comprises less than 15%, preferably less than 10%, and more preferably less than 5% of a liquid impregnating carrier and other liquid components of the impregnating liquor, based on the weight of the total weight of the loaded substrate. If the substrate is a composite or zoned material, each of the composite regions or zones should preferably satisfy the dryness requirement.

Cleaning Composition

A cleaning composition useful for the current invention can comprise conventional cleaning surfactants.

In a first execution, preferred compounds for the cleaning compositions comprise non-ionic or amphoteric surfactants, such as ethoxylated or propoxylated fatty acids or fatty alcohols, alkylamineethoxylates, or glucosides.

Particularly preferred surfactants for the cleaning compositions are a $C_{12}$ to $C_{18}$ fatty alcohol ethoxylate, such as Dehydol® LT or a sodium $C_{12}$-$C_{16}$ fatty alcohol sulfate, such as SULFOPON® 1216G or a sodium cetostearysulfate SULFOPON® T35, all of Cognis Chemicals, Germany, (now BASF SE, Germany), or TRILON® of BASF SE, Germany.

In another execution, the cleaning composition may exhibit an alkaline pH-value. This can be achieved by using surfactants exhibiting inherently higher pH values, such as without any limitation, ethoxylated aliphatic monohydroxy alcohols, or by the addition of conventional alkaline additives, such as sodium hydroxide, potassium hydroxide, sodium perborate etc., to surfactants of the first execution mentioned in the above. These executions exhibit an improved performance in particular with regard to cleaning of fatty components, in particular when the substrate as being loaded with such alkaline cleaning compositions exhibits a pH value of between 8.0 and 9.5 (EN1413).

The cleaning composition should allow thermal drying and henceforth have a moderate volatility up to conventional drying temperatures, i.e. between 50° C. and 90° C. Preferably, such compounds are used at an overall amount in the cleaning liquor of up to 10 weight-%.

Impregnating Aid

It is believed that treating the substrate with an impregnating aid supports the effect of immobilizing and/or retaining the cleaning composition in or on the surface of the substrate.

An impregnating aid may be added at various stages. In a first execution, an impregnating aid may be added during the washing of the substrate, and the impregnating aid may be added to the washing liquor as such or in combination with the washing composition.

In a second execution, an impregnating aid can be added after the washing, preferably after the removal of a portion of the washing carrier, but before the combining with the cleaning composition. In this case, the impregnating aid may be added as such, preferably in a liquid form to allow easy distribution in or on the surface of the substrate, or the impregnating aid may be added by means of a fluid impregnating aid carrier, such as water. The impregnating aid carrier may simultaneously be the impregnating carrier, if this in combined with the substrate prior to the combining with the cleaning composition.

It should be noted, that these executions are not exclusive, but that one and the same or different impregnating aids may be added by more than one execution. Preferred impregnating aids may be poly-electrolytes and especially anionic poly-electrolytes. Anionic poly-electrolytes comprise anionic groups such as hydroxyl-, carboxylate-, sulfate-, and sulfonate-groups. These groups may be combined with a polymeric backbone, such as polymers of olefinically unsaturated compounds, such as being based on acrylic acid, methacrylic acid, maleic acid, or derivatives of sulfonic acid, such as allyl sulfonic acid, or vinyl sulfonic acid. The polymeric backbone may also be based on polyester. Such poly-electrolytes may be employed partially or completely neutralized or in their protonized form.

Preferred poly-electrolytes are sodium carboxy methylcellulose (CMC), sodium poly-styrolsulfonate, or acrylic amide/acrylic acid co-polymers or mixtures thereof. A particularly preferred poly-electrolyte is ethylcellulose, such as BERMOCOLL™ EBS 431 FQ of Akzo Nobel Functional Chemicals AB, Sweden. Depending on the type of the poly-electrolyte it may be employed at concentrations of from 0.2% up to 5% or even more.

Impregnating Carrier

The distribution of the impregnating composition in or on the substrate may be facilitated by the use of an impregnating carrier.

Typically the impregnating carrier is a liquid carrier, such as water or solvents, or any other liquid, which allow dissolving of the cleaning compositions therein or which allow formation of dispersions or emulsions of cleaning composition or parts thereof in the carrier. Carriers on an aqueous basis may optionally comprise non-aqueous components such as alcohols, or a carrier may be on anon-aqueous base, such as oils. Preferably, the carriers are in a liquid state at room temperature but also during the temperatures of the washing, loading and drying cycle, i.e. up to about 90° C. Preferably, the carriers are sufficiently volatile to allow drying, but not too volatile to allow reasonably long cleaning episodes. Carriers should not be harmful to people and/or environment. A particularly preferred carrier is water.

The concentration of the cleaning composition in the liquid impregnation carrier can range from about 0.2 weight-% to about 10 weight-% or more (by weight) calculated to the bases of the dry, loaded, substrate.

Impregnating Composition and Liquor

The impregnating composition for loading the substrate with the cleaning composition comprises the cleaning composition and may further comprise an impregnating aid, or optional other additives.

Optionally the impregnating composition comprises a pH adjustment. For certain executions, it has been found to be advantageous if the impregnating is carried out under slightly acid condition of a pH of between 3.5 and 5.5. This may be achieved by any conventional pH adjustment or buffer, and monohydric citric acid has been found particularly useful.

The combination of the impregnating composition with a liquid impregnating carrier results in the impregnation liquor. If the impregnation composition in itself is liquid, be it due to liquid compounds of the cleaning composition, due to liquid impregnation aids or impregnation aids carrier, or other liquid additives, an additional carrier may not be necessary.

Optional Additives

Optionally, various additives may be added to the various compositions at various stages. Generally, the additives should have properties that will impose no major changes in the process steps after their addition, and conversely the additives should not be prone to deteriorations due to the subsequent process step.

Often it may be preferred to add odour compounds or components to the compositions, such that in particular the loaded substrate and/or the cleaning liquor have a pleasant smell. Such odour compounds may have the ability to catch or camouflage unpleasantly smelling compounds of any of the compositions, such as well known cyclodextrines or similar compounds. Other odour compounds like perfumes or fragrances may also camouflage an unpleasant smell or just add pleasantly smelling compounds. Any of these odour compounds should be selected and applied such that there is minimal loss in subsequent process steps. Thus they may be added as dry or micro-encapsulated ingredients to the substrate after this has been loaded with the cleaning composition and has been partly or completely dried. In a preferred embodiment, the odour compounds are added at the impregnating step to the cleaning composition or to the impregnating liquor (which may also be the same as the washing liquor).

Such perfume or fragrance compounds may be of the ester type and preferably selected from the group consisting of compounds like methyl butyrate, methyl acetate, ethyl acetate, hexyle acetate, geranyl acetate, isoamyl acetate, octyl acetate, of the terpenes type, such as linear terpenes preferably selected from the group consisting of citronellol, citronellal, citral, linalool, myrcene, and geraniol, or cyclic terpenes preferably selected from the group consisting of limonene and thujone, or of the aromatic type, preferably selected from the group consisting of thymol, cinnamaldehyde, benzaldehyde. Also certain alcohols, such as menthol or furaneol, aldehydes, such as acetaldehyde, or hexyl cinnamaldehyde, haven been found to be very useful. Less preferred are ketonic, lactonic or thiol compounds, as these often do exhibit odours which are less associated with "cleanliness".

Particularly preferred perfume additive compounds are selected from the group consisting of eucalyptol, thymol, lillal, citronellol, amylcinamaldehyd, 4-tert-butyl-cyclohexylacetate, hexyl cinamaldehyde, benzylacetate, iso-bornylacetate, gamma-iso-methylionone, tetrahydrolinalool, dihydromyrcenol, methylionon, d-limonene, methyloleate, orange peel oils, linalool.

In addition to the requirement, that the odour additives shall survive subsequent process steps with least degradation, it is often desired, that the odour additives are transferred from the substrate, and to the cleaned surface so as to impart a smelling connotation with cleanliness.

The odour compounds are preferably added at a level of 0.001 weight-% to about 2 weight-% for each pure compound on the basis of the cleaning composition, i.e. the numbers need adjustment in case of the compounds being added in a solvent or as an amulsion, or if they are added via the impregnating composition or liquor.

In order to effectively add various odour compounds it is often preferable to use emulsifier, as being well known in the art of odour additives. It should be noted, that certain odour compounds have an inherent emulsifying function, such as actetate compounds, furaneol, acetaldehyde, hexyl cinnamaldehyde. Other suitable emulsifier can be conventional surfactants exhibiting preferably an HLB value of from about 6 to about 12. Thus, surfactants as found useful for the cleaning omposition, as described hereinabove, can suitable serve as emulsifier for odour components. Other solubilisation aids may be used, such as ethyl alcohol, iso-propylalcohol, ethyl carbonate, ethyl acetate, benzylalcohol, benzylbenzoate, propylenglycol, 1,3-butylenglycol, dimethylformamide, glycerine, tetra-hydrofurfurylalcohol, polyethylenglycol and fatty acid ester of sorbitan. Particularly preferred ones are benzyl alcohol, propane-diols, in particular 1,2-propane-diol, and 2-phenoxy ethanol.

Preferred emulsifiers are preferably applied at a level of about 0.2 weight-% to about 15 weight-% of pure emulsifiers on the basis of the cleaning composition, i.e. the numbers need adjustment in case of the compounds being added in a solvent form, or if they are added via the impregnating composition or liquor.

Typically odour compositions comprise from about 5 weight-% to about 30 weight-% of the odour compound, from about 2 weight-% to about 50 weight-% emulsifier in a odour carrier, often water, these percentages being based on the combined weight of odour compound, emulsifier and carrier.

Even though the present invention provides a particular advantage that preservatives are not required to allow storage and transport of the dry loaded substrate, such additives may be added to particularly stringent storage conditions, such as long duration, and/or high temperatures and/or high relative humidity conditions. Even further, such additives may be added to impart preserving properties to the cleaned surface.

Thus, very suitable compounds to be used as preservatives are cationic surfactants, aldehydes and halogenic compounds, added at levels from between 0.2 weight-% to about 8 weight-% on the basis of pure additive relative to the cleaning composition. In a particular application, 0.05 weight-% of a non-ionic isothiazolone, commercially available under the trade designation Afrotin WSK from Schill & Seilacher GmbH, Germany.

Cleaning Kit

Thus in a further aspect, the present invention is a cleaning kit comprising a reusable and washable substrate and a cleaning composition. The kit is adapted to allow multiple use of the substrate with renewed loading of the cleaning composition. Therein the loaded substrate comprises (i) at most 15 weight-%, preferably not more than 10 weight-%, and more preferably at most 5 weight-% of a liquid carrier based on dry weight of the substrate, and (ii) at least a first substrate region having a volume extension of at least 125 $mm^3$ comprising at least 1 weight-%, preferably more than 5 weight-%, more preferably more than 20 weight-% and most preferably more than 40 weight-% of a cleaning composition based on the dry weight of the substrate.

Method of Preparing a Loaded Dry Substrate

In a further aspect, the present invention relates to a method of loading a reusable and washable substrate with a cleaning composition to prepare an essentially dry substrate loaded with cleaning composition. The loading may be performed as the last step of a washing cycle, or it may be performed in a separate step.

The process comprises the following steps:

a) Providing a washable and re-usable substrate pad, optionally comprising residuals of a washing carrier, further comprising a cleaning composition, and providing an impregnating aid;

b) Combining the impregnating aid with the substrate pad, optionally by wetting the substrate with a liquid impregnating carrier;

c) Loading the substrate pad by combining the substrate pad with the cleaning composition;

d) Optionally mechanically removing excess carrier, preferably by draining, squeezing or spinning, whilst optionally capturing of the excess carrier for subsequent repeating of the process;

e) thermally treating the loaded pad, preferably between 50° C. and 90° C. thereby removing residual carrier to a liquid carrier load of less than 15 weight-%, preferably less than 10 weight-% and more preferably less than 5 weight-% on a dry weight basis of the substrate, and immobilizing at least 1 weight-%, preferably more than 5 weight-% more preferably more than 20 weight-% and most preferably more than 40 weight-% on the basis of weight of the dry substrate of the cleaning composition in or on the surface of the substrate.

In a preferred execution, the cleaning composition comprises (i) non-ionic or amphoteric surfactants, preferably selected from the group consisting of ethoxylated or propoxylated fatty acids, fatty alcohols, alkylamineethoxylates, and glucosides. or (ii) alkaline surfactants such as without any limitation ethoxylated aliphatic monohydroxy alcohols.

The impregnating aid may be added by at least one of the following steps:

(i) during the washing of the substrate prior to providing the washed substrate;

(ii) separately after the washing but before addition of the cleaning composition in a liquid form or by means of an impregnating aid carrier;

wherein the impregnating aid may comprise same compounds or different compounds for any of these steps.

In a preferred execution, the impregnating aid is a polyelectrolyte, preferably anionic poly-electrolyte.

In the particular execution (ii) the impregnating aid may be added to the substrate after the washing is completed and a dewatering (such as by spinning) of the substrate has occurred, but not necessarily the drying is completed. This can be done in analogy to the addition of fabric softener to the last rinse, or to the impregnating of waterproof apparel or the like. Optionally, the impregnating aid may be added together with some or all of the impregnating carrier. After the substrate is treated with the impregnating aid, the cleaning composition may be added, such as with additional impregnating carrier. During the impregnating step, the ratio of impregnating liquor to substrate can be kept at a low level, such as at a liquor ratio (i.e. weight of dry substrate to liquor) of 1:2 or less. Optionally, when an excess of cleaning liquor is employed, unused liquor may be recycled for a further loading cycle, optionally upon adjustment of the concentration of the impregnation or at least cleaning composition therein. However upon appropriate selection of washing composition and cleaning composition, the washing and the impregnating with the cleaning composition can be done simultaneously, e.g. during a main wash step of a washing machine, if at least 1.0 weight-%, preferably 5 weight-%, more preferably more than 20 weight-% and most preferably more than 40 weight % of the cleaning composition can be immobilized in or on the surface of the substrate. Preferably the drying may be executed in a conventional drying or impregnating step, such as in a tumble dryer, to remove excess liquid of the carrier. The drying step may further support the immobilization of the cleaning composition in or on the substrate. Preferably, the immobilization is predominantly achieved by non-covalent bonding, i.e. at least half if the temporarily immobilized composition can be readily removed.

Method of Cleaning Surfaces by Using a Washable and Re-Usable Loaded Dry Substrate In yet a further aspect, the present invention relates to the method of cleaning surfaces, such as—without implying any limitation—floors or windows.

This aspect allows to prepare an essentially dry substrate pad loaded with a cleaning composition, which is ready for being employed for cleaning upon the addition of the cleaning carrier, which may be simply water. The cleaning step is typically performed at a location separate from the preparation (i.e. washing and loading) of the pad, and at a later time. Henceforth, it is a particular advantage of the present invention, that the loaded pads can be stored and transported easily, even without necessitating further precautions such as against wetting of the storage space, drying out of the pads, or molding or mildewing prevention measures, such as by moisture proof packaging. The dirt loaded substrate pad may be washed and re-loaded with the cleaning composition.

Without wishing to be bound by the theory, it is believed that a particular selection for the washing composition enhances the impregnating of the substrate with the cleaning composition. For example, if the substrate comprises cellulose based fibres, this can be achieved by creating a charge transfer complex effect, cationization or sulfatazing of the fibres, or if the substrate comprises polyester fibres, the wetting properties may be improved by thermo-sublimating compounds.

Preferred compounds for this purpose can be selected from the group consisting of aliphatic and aromatic carboxylic acid and derivatives such as esters thereof, alkylsulfonates, arylsulfonates, or alkylarylsulfonates.

The concentration of the washing composition may range from about 0.5% to about 3% by weight of the washing composition based on the weight of the washing liquor, i.e. weight of the substrate being disregarded.

Thus, the present invention is a method for the cleaning of surfaces comprising the following steps in the following order:

1) providing
   - a reusable washable substrate pad, optionally loaded with dirt from previous cycles;
   - a washing liquor comprising a washing composition and a washing carrier;
   - a cleaning composition,
   - an impregnating aid,
   - optionally an impregnating carrier;
   - a cleaning carrier for the cleaning;
2) washing the substrate with the washing liquor, if present removing dirt from the substrate;
3) optionally removing, preferably mechanically, at least a part of the washing carrier, preferably by draining, wringing, squeezing, pressing or spinning;
4) loading the substrate pad by combining the substrate pad with the cleaning composition, optionally in the presence of a liquid impregnating carrier;
5) optionally mechanically removing excess carrier, preferably by draining, squeezing or spinning, optionally capturing of the excess carrier for the repeating of the steps;
6) thermally treating the loaded pad, preferably between 50° C. and 90° C. thereby
   - removing residual carrier to a liquid carrier load of less than 15 weight-%, preferably less than 10 weight-% and more preferably less than 5 weight-% on a dry weight basis of the substrate,
   - and immobilizing at least 1 weight-%, preferably more than 5 weight-%, more preferably more than 20 weight-%, and most preferably more than 40 weight-% on the basis of weight of the dry substrate of the cleaning composition in or on the surface of the substrate.
7) storing and/or transporting the loaded dried substrate to a cleaning location;
8) wetting the loaded dry substrate with a cleaning carrier, preferably water;
9) cleaning a cleaning surface with the wetted substrate, thereby collecting dirt on or in the substrate; optionally leaving cleaning liquor comprising cleaning carrier, cleaning composition, and optionally cleaning additives on the cleaned surface;
10) storing/transporting the dirt loaded substrate to a washing location, In addition, the method further comprises the adding an impregnating aid, wherein the impregnating aid is added by at least one of the following steps:

(i) during the washing of the substrate prior to providing the washed substrate;
(ii) separately after the washing but before addition of the cleaning composition in a liquid form or by means of an impregnating aid carrier;
(iii) as a compound of the impregnating composition
(iv) as a chemical group chemically connected to a cleaning compound of the cleaning composition;
(v) as a chemical group chemically connected to the cleaning substrate or incorporated into the composition thereof, wherein the impregnating aid may comprise same compounds or different compounds for any of these steps (i) to (v).

The steps 1 to 10 and optionally the step of adding the impregnating aid may repeated in a recycling loop.

In a particularly preferred execution of the process, step 8), i.e. the wetting of the substrate with the cleaning carrier is executed by applying the so called Avet SpraMop method, such as further described in EP1180343A1.

Test Methods

Substrate Sample Preparation

Depending on the test and the sample, the sample can be use in toto, by selecting representative sub-samples so as to determine average values over the sample, or by selecting specific regions or zones so as to determine local properties. The smallest volume for any such determination of local properties should not be below 125 $mm^3$, such as may be represented by a cube of 5 mm.

Substrate Thickness

The substrate thickness may be determined by applying ISO 5084.

pH Determination

The pH of textiles may be determined by using the test method EN1413 (aqueous extraction).

Surface Cleaning Performance

This is assessed by employing the "Recommendations of the quality assessment of all-purpose cleaners" issued by Industrieverband Körperpflege und Waschmittel e.V. (IKW) in 2004 and published in "Seifen-Öle-Fette-Wachse Journal", 130, 10-2004, pages 83-93 (original German version), and SÖFW-Journal 131, 9-2005, pages 54-66 (English version).

The method was adapted by using as cloth a commercially available microfiber mop pad supplied by Avet AG, Switzerland, under the designation Avet ClaraClean.

The Cleaning efficiency was then judged on a scale of 0 (no dirt removed) to 10 (complete dirt removed). The streak formation or dry cleaning behavior was judged on a scale of 0 (no residues) to 4 (very strongly noticeable residues).

Surfactant Release and Substrate Loading Determination

In order to determine the amount of surfactant released by a substrate, this treated in a Soxhlet extractor at 20° C. with tap water for several cycles and the amount of extracted surfactant is determined after each cycle. Then, the Metrohm SurfPAC™ standard method A3 has been employed by using electrode type NIO (6.0507.010).

Substrate Carrier Content Determination

In case of the carrier being an aqueous liquid, the determination can be executed by the weight loss method by weighing the substrate prior and after a 3 hr drying at 120° C. in a ventilated oven or under vacuum.

In case of other liquids, the drying time and temperatures will be adapted accordingly.

EXAMPLES

Example 1

A commercially available washable floor cleaning substrate type Avet ClaraClean was provided. It is composed of a striped arrangement of looped and twisted yarns of polyester and a mixture of polyamide with polyester. It has a dry weight of approximately 150 g.

Further, a washing composition was provided comprising

| | |
|---|---|
| Metha silicate (anhydrous) | 44.00 weight % |
| Sodium carbonate | 37.65 weight % |
| Sodium citrate (di-hydrate) | 4.8 weight % |
| non-ionic surfactant ($C_{13}/C_{15}$-7 ethoxylated groups) | 4.2 weight % |
| phosphoric acid ester | 3.5 weight % |
| poly-maleic acid | 2.7 weight % |
| anionic surfactant Alkylaryl sulfonate | 1.75 weight % |
| 1-hydroxyethane 1,1-diphosphonic acid (HEDP) | 1.4 weight % |

4 kg (dry basis) of substrate were washed in a conventional drum washing unit with a main wash cycle of 25 minutes at 60° C. The washing liquor was made of 4.6 grams washing composition per liter water having a water hardness of 16.8° dH and used at a liquor ratio (dry weight of washed substrates to washing liquor) of 1:5 at a loading ratio (dry weight of washed substrate to washing drum volume of 75 l) of 1:12. After one minute of dewatering, and one minute of spin-drying at 1000 rpm (at a diameter of 0.52 m), the substrate had a water loading of approximately 150 weight-% (on a dry substrate basis).

For the first part of the impregnating, the following was added to the substrate with some tap water:

| | |
|---|---|
| monohydric citric acid | 4.1 weight % |
| ethyl cellulose | 1.5 weight % |
| BERMOCOLL EBS 431 FQ of Akso Nobel Functional Chemicals AB, Sweden | |

After a first treatment time of 2 minutes at 30° C., the cleaning composition was added with some tap water:

| | |
|---|---|
| $C_{12}$ to $C_{18}$ fatty alcohol ethoxylate (surfactant) Dehydol ® LT of Congnis Chemicals, Germany, (now BASF SE, Germany) | 2.8 weight % |

such that the total impregnating liquor had 91.6 weight % tap water and the liquor ratio was of 1:2. The substrate was treated at 30° C. for further 2 minutes, followed by 1 minute of dewatering and one minute of spin-drying at 150 rpm (0.52 m diameter).

Thereafter, the substrate had a wet loading of approximately 300 weight %. The loading of the surfactant in the substrate was determined to 33.9 g per 1 kg wet substrate by the method as described as described.

Water was removed by tumble drying at 70° C. to a residual water content of 3 weight-%. Thus the finished loaded dry substrate has been prepared, and a pad of 150 g contained further 4.5 g water and 20.3 g of surfactant.

Such loaded dry pad can be conveniently stored and transported to the cleaning location without particular precautions as may be required when wet substrates are produced and transported without drying.

For use as a floor cleaning pad, the pad is wetted by tap water at by employing a conventional cleaning implement such as commercially available at Avet AG, Switzerland.

The System was evaluated for its cleaning efficiency and streak formation with very good results, as summarized in Table 1.

Example 2

In a second trial the conditions of example 1 were repeated except for the anionic cleaning surfactant being replaced by the same amount of an amphoteric surfactant, namely N-tetradecyl-dimethyl-3-ammonio-propane-sulfonate (CAS 14933-09-6). The cleaning performance (see Table 1) was reduced versus example 1, but still considered good.

Example 3

In a third trial the conditions of example 1 were repeated, except that in the washing composition the anionic surfactant alkylaryl sulfonate was replaced by a cationic surfactant, a quartenary coco-alkyl-methylamineethoxylatemethylchloride, under the trade name of Berol R648 of Akzo Nobel, The Netherlands.

Example 4

In a fourth trial, the anionic surfactant alkylaryl sulfonate in the washing composition was replaced by a non-ionic composition, namely $C_{12}$ to $C_{18}$ fatty alcohol ethoxylate (Dehydol™ of Cognis Chemicals, now BASF SE, Germany, and the poly-electrolyte was replaced by a cationic one, namely poly-diallyl-dimethyl-ammonium-chloride (CAS 26062-79-3).

Example 5

In a fifth trial, the formulation of example 4 was modified by replacing the non-ionic washing surfactant by the cationic one as used in Example 3.

Example 6

In a sixth trial, the formulation of example 4 was modified by replacing the non-ionic washing surfactant by the anionic one as used in Example 1.

TABLE 1

Cleaning test results

| | Cleaning Efficiency | Stream Formation |
|---|---|---|
| Example 1 | 7.7 | 0 |
| Example 2 | 6.6 | 1-2 |
| Example 3 | 5.1 | 2 |
| Example 4 | 5.3 | 4 |
| Example 5 | 3.0 | 3 |
| Example 6 | 4.4 | 2-3 |

The invention claimed is:

1. A process of loading a reusable and washable surface cleaning substrate for repeated use and wash cycles with a cleaning composition, comprising the following steps:

a) providing:
- a washable and reusable substrate pad
- a cleaning composition;
- an impregnating aid; and
- a pH adjustment capable of adjusting a pH to slightly acidic conditions;

b) combining said impregnating aid with said substrate pad,
- (i) during the washing of the substrate prior to providing said washed substrate, or
- (ii) separately after the washing but before addition of the cleaning composition in a liquid form or by means of an impregnating aid carrier, c) loading the substrate pad by combining the substrate pad with said cleaning composition, and d) thermally treating the loaded pad, thereby
- removing residual carrier to a liquid carrier load of less than 15 weight-%, on a dry weight basis of the substrate; and
- immobilizing at least 1 weight-% on the basis of weight of the dry substrate of said cleaning composition on the surface of or in said substrate.

2. The method according to claim 1, wherein said cleaning composition comprises:
- (i) non-ionic or amphoteric surfactants or
- (ii) alkaline surfactants.

3. The method according to claim 1, wherein said impregnating aid is a poly-electrolyte.

4. The method according to claim 1, wherein said impregnating carrier is selected from the group consisting of aqueous and solvent based liquids.

5. The method for the cleaning of surfaces with a reusable and washable substrate for repeated use and wash cycles, said method comprising the following steps in the following order:

1) providing:
- a reusable washable substrate pad;
- a washing liquor comprising a washing composition and a washing carrier;
- a cleaning composition,
- an impregnating aid, and
- a cleaning carrier for the cleaning;

2) washing the substrate with the washing liquor, and if present removing dirt from the substrate;

3) loading the substrate pad by combining the substrate pad with the cleaning composition, 4) thermally treating the loaded pad, thereby
- removing residual carrier to a liquid carrier load of less than 15% on a dry weight basis of the substrate, and
- immobilizing at least 1 weight-% on the basis of weight of the dry substrate of said cleaning composition in or on the surface of said substrate, 5) storing and/or transporting the loaded dried substrate to a cleaning location;

6) wetting the loaded dry substrate with a cleaning carrier;

7) cleaning a cleaning surface with said wetted substrate, thererby collecting dirt on or in the substrate;

8) storing/transporting the dirt loaded substrate to a washing location, said method further comprising the step of adding an impregnating aid, wherein said impregnating aid is added by at least one of the following steps:
- (i) during the washing of the substrate prior to providing said washed substrate;
- (ii) separately after the washing but before addition of the cleaning composition in a liquid form or by means of an impregnating aid carrier;

wherein the impregnating aid may comprise same compounds or different compounds for any of these steps (i) to (ii), and repeating steps 1) to 8) in a recycling loop.

6. The method according to claim 5, wherein said washing carrier, said impregnating carrier, if present, and said cleaning carrier are aqueous liquids.

7. A process of loading a reusable and washable surface cleaning substrate with a cleaning composition according to claim 1, wherein said slightly acidic conditions are a pH of between 3.5 and 5.5.

8. A process of loading a reusable and washable surface cleaning substrate with a cleaning composition according to claim 1, wherein said pH adjustment is citric acid.

9. A process of loading a reusable and washable surface cleaning substrate with a cleaning composition according to claim 1, wherein said thermal treatment is executed between 50° C. and 90° C.

10. A process of loading a reusable and washable surface cleaning substrate with a cleaning composition according to claim 1, whereby residual carrier is removed to a liquid carrier load of less than 10 weight-% on a dry weight basis of the substrate.

11. A process of loading a reusable and washable surface cleaning substrate with a cleaning composition according to claim 1, wherein more than 20 weight-% on the basis of weight of the dry substrate of said cleaning composition are immobilized on the surface of or in said substrate.

12. A process of loading a reusable and washable surface cleaning substrate with a cleaning composition according to claim 1, wherein more than 40 weight-% on the basis of weight of the dry substrate of said cleaning composition are immobilized on the surface of or in said substrate.

13. A method according to claim 2, wherein said non-ionic or amphoteric surfactants are selected from the group consisting of ethoxylated or propoxylated fatty acids, fatty alcohols, alkylamineethoxylates, and glucosides.

14. A method according to claim 3, wherein said poly-electrolyte is an anionic poly-electrolyte.

* * * * *